US005531453A

United States Patent [19]

Penston, III

[11] Patent Number: 5,531,453

[45] Date of Patent: Jul. 2, 1996

[54] BOXING GAME SYSTEM AND METHOD OF PLAY

[76] Inventor: Philip A. Penston, III, 1031 Union St., Clearwater, Fla. 34615

[21] Appl. No.: 329,443

[22] Filed: Oct. 26, 1994

[51] Int. Cl.[6] ..... A63B 71/02

[52] U.S. Cl. ..... 273/440; 273/DIG. 26

[58] Field of Search ..... 273/440, 57.3, 273/DIG. 26

[56] References Cited

U.S. PATENT DOCUMENTS

| | | | |
|---|---|---|---|
| 2,916,287 | 12/1959 | Davey | 273/57.3 |
| 3,943,505 | 3/1976 | Berzin et al. | 273/DIG. 26 X |
| 4,842,275 | 6/1989 | Tsatskin | 273/440 X |

FOREIGN PATENT DOCUMENTS

| | | | |
|---|---|---|---|
| 2741090 | 3/1979 | Germany | 273/57.3 |

OTHER PUBLICATIONS

Seaton, Clayton, Leibee, and Messersmith, Physical Education Handbook, sixth edition, pp. 409–418 Dec. 1974.

*Primary Examiner*—Paul E. Shapiro
*Attorney, Agent, or Firm*—A. W. Fisher, III

[57] ABSTRACT

A new boxing game system and method of play in which a team of boxers is used to win a boxing bout using a unique scoring system. The team of boxers consists of a plurality of boxers with each boxer representing a different divisional weight class. An open type of scoring apparatus is used to openly display each judge's score for each boxer throughout the entire boxing bout which will allow the public audience to know which boxer is winning during the boxing bout. A unique type of point scoring system is used to determine which boxing team will win the boxing bout. An audio visual indicator is used to notify a losing boxer that he cannot mathematically win the boxing bout by either a unanimous or split decision.

8 Claims, 3 Drawing Sheets

BOXING GAME SYSTEM AND METHOD OF PLAY

BACKGROUND OF INVENTION

1. Field of the Invention

This invention is related to a new system and method of play for the sport of Boxing. More specifically, this new system incorporates many of the traditional rules and regulations of the general rules for boxing with unique modifications. The use of a team of boxers from a plurality of countries vying to become the world championship team, and a unique type of open scoring system is incorporated in this unique system of boxing.

2. Description of the Prior Art

The sport of Boxing has a rich and varied history, but suffers tremendously from a public image standpoint as a minor league sport with unscrupulous promoters, unsavory managers, etc. As one of the most famous global spectator sports, the sport of boxing has remained essentially unchanged over the many years. For example, boxers are still awarded victories as individuals unlike many other professional team sports. The scoring system of boxing is still held in secrecy until the conclusion of the boxing bout and an individual boxer is awarded a victory. Finally, the current methods of producing championship boxing bouts between two boxers is to utilize a highly subjective ranking system that can be manipulated by unscrupulous promoters. There currently does not seem to be any objective or systematic way of producing boxing champions.

That being said, however, millions upon millions of dollars are made each year in the sport of Boxing that has no structure, unlike the National Basketball Association, the National Football League, and the National Hockey League. This allows a few promoters to control the sport of boxing, or boxing sanctioning organizations; i.e., (WBC, WBA, WBO, WBF, IBF, IBC, USBA, NABF, AD INFINITUM) that are in existence solely to generate fees under the guise of rating fighters. Ultimately, the fighters lose out when their careers go downhill, with no medical insurance, retirement pensions, workman's compensation, etc.

Currently, there has been many controversies with the methods employed in the current scoring system. Riots have even resulted when the scores of the boxers do not reflect the performance of the boxing bout. This problem has been primarily due to the closed type of scoring system currently used in the sport of boxing today. Using the current closed scoring system, there always seems to be some type of controversy at the conclusion of the boxing bout when the winners are announced.

In the present invention, the ordinary spectator will be able to tell which boxer is winning at any time during the fight. A scoreboard of the judge's current scores will constantly be displayed for the public audience to view throughout the boxing bout. This will eliminate any controversies or speculation during the fight as to who the winner will be. Also, the trainers and boxers themselves will also know who is ahead on points and thus the open scoring method will encourage the boxer, losing on points, to fight harder. When a boxer knows that he cannot mathematically win by points alone, the boxer must then go for a knockout to win, which will greatly intensify the excitement of the boxing bout.

There does not seem to be any closely related prior arts in the field of boxing, however other related sports are shown hereunder that provide for teaching methods of playing varies sports, in Moore of U.S. Pat. No. 5,207,433 the abstract states, "The present invention relates to a variation of the traditional American football game concentrating on the passing aspects which demands virtually all of the athletic skills of traditional football, but capable of being played by a minimal number of players. The subject game including a new apparatus and method of playing employs a number of the refinements of the professional football passing game, based upon its timing and spacing aspects to provide a real athletic challenge, which game may be played on a smaller field, on both inside and outside facilities, the playing field consisting of a level open space at least 40 yards long and 30 yards wide. Spaced apart markers are used to designate the offensive receiver positions for throws passed and varied defensive alignments to prevent successful passing into a plurality of stationary nets or baskets."

In Brim, of U.S. Pat. No. 4,884,806, the abstract states "A method of playing a bowling game in which players are allowed at least one ball to deliver during a turn of play. A given trajectory is selected for a ball to follow down a lane. A player is required to deliver at least one ball down the lane in an attempt to duplicate the given trajectory. The degree to which the player's delivered ball duplicates the given trajectory is determined. A score is awarded to the player which is a function of the degree to which the player's ball duplicated the given trajectory."

All current methods of boxing teach the method of winning only for individual title rights and not as team effort. Additionally, the current methods of boxing use only a closed type of scoring system that is concealed from the public viewing unlike the present invention. In viewing the prior art, there seems to be none, that teach or suggest all of the advantages of the present invention disclosed herein.

SUMMARY OF THE INVENTION

It is a primary object of this invention to provide a variation of traditional Boxing that incorporates the use of a team of boxers competing against other teams to win a boxing bout. Each team consists of a plurality of boxers with each boxer representing a different weight class division.

Another object of this invention is to provide a scoring system that is open to the public audience. This open scoring system would allow the public audience to know who is winning the boxing bout at all times throughout the boxing bout. The open scoring system also will eliminate any controversies at the end of the boxing bout as to who the winner of the boxing bout is when the winners are announced as in traditional boxing.

A further object of this invention is to provide a unique type of point scoring system is which a team of boxers wins by accumulating more points at the end of the boxing bouts than their opponents. A given amount of points are given to each boxer of each weight class pending the outcome of the boxing bout. The points are then added from each boxer of each weight class giving the team a total amount of points. The team with the greater amount of points at the end of the boxing bout wins.

Another object of this invention is to provide a tournament format wherein boxing teams from countries compete against boxing teams of other countries for a world championship title.

Still, another object of this invention is to provide a tournament format wherein boxing teams from cities compete against boxing teams of other cities for a national championship title.

Yet another object of this invention is to provide a tournament format wherein boxing teams from North and South American countries compete for the America's Cup title.

Another object of this invention is to provide a twelve month season of play wherein the first eight months are dedicated to league boxing bouts wherein a single team of boxers represent their country for international competition.

Still, another object of this invention is to provide five weight class divisions. Each team will have at least one boxer to represent at least one weight class division. A plurality of substitute boxers can be added to a boxing team in case there are injuries or sicknesses.

A further object of this invention to provide an open type of scoring system. The judge's current scores of who is winning the boxing bout can be constantly monitored by the public audience as well as the fighters themselves.

Still a further object of this invention is to provide an interactive media whereby public viewers will be able to interact with other public viewers in predicting specific outcomes of the boxing bout. Predictions of which round is won, the number of punches thrown, which round a boxer is knocked down, and a variety of other pertinent information will be included. The interactive media system would be controlled via computers and telecommunication systems.

Still another object of this invention is to provide a scoreboard type apparatus to display a plurality of information thereon. A video monitor, an audio system, statistics of the boxing bout, judge's scores, team scores and a variety of other pertinent information would be displayed. The audio system having capabilities of amplifying audio signals originating from the boxing ring vicinity thereby allowing the public audience to hear the sounds from the punches thrown and landed during the boxing bout.

Another object of this invention is to provide an audio visual indicator to notify a boxer that he is mathematically eliminated from winning the boxing bout by either unanimous or split decision. A flashing siren could be used to notify a losing boxer that he can only win by knockout. This audio visual indicator should make the losing boxer more aggressive to try to win the fight by knockout thereby intensifying the excitement of the boxing bout.

It has been customary for the scores of the boxers to be held secretly by the judges until the conclusion of the fight. This type of closed scoring system has led to many controversies in the past when the winner of the fight is announced at the end of the fight. With an open type of scoring system, the public audience will be allowed to cheer for their favorite boxer when he is down on points. Another additional advantage of having an open type of scoring system is that when a boxer knows that he cannot win by points alone, and can only win by a knockout, this will push the boxer to go for a knockout thereby intensifying the boxing bout.

In carrying out this invention in the illustrative embodiment thereof, a new method for playing the sport of boxing is used by having a plurality of boxers forming a team to compete against other teams. An additional innovation of the invention is to have a unique type of open scoring apparatus that will enable the commons spectator to view the scores given to each boxer by the judges panel during the boxing bout.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet one contains FIG. 1, a perspective view of the boxing arena with the open type of scoring apparatus suspended above the ring. The scoring apparatus comprises a plurality of information throughout the boxing bout, such as round by round scores of each boxer, the total cumulative scores for each boxer, punch statistics, fouls assessed, number of knockdowns, a jumbo video monitor for instant replays, and advertising spaces.

Figure 2:
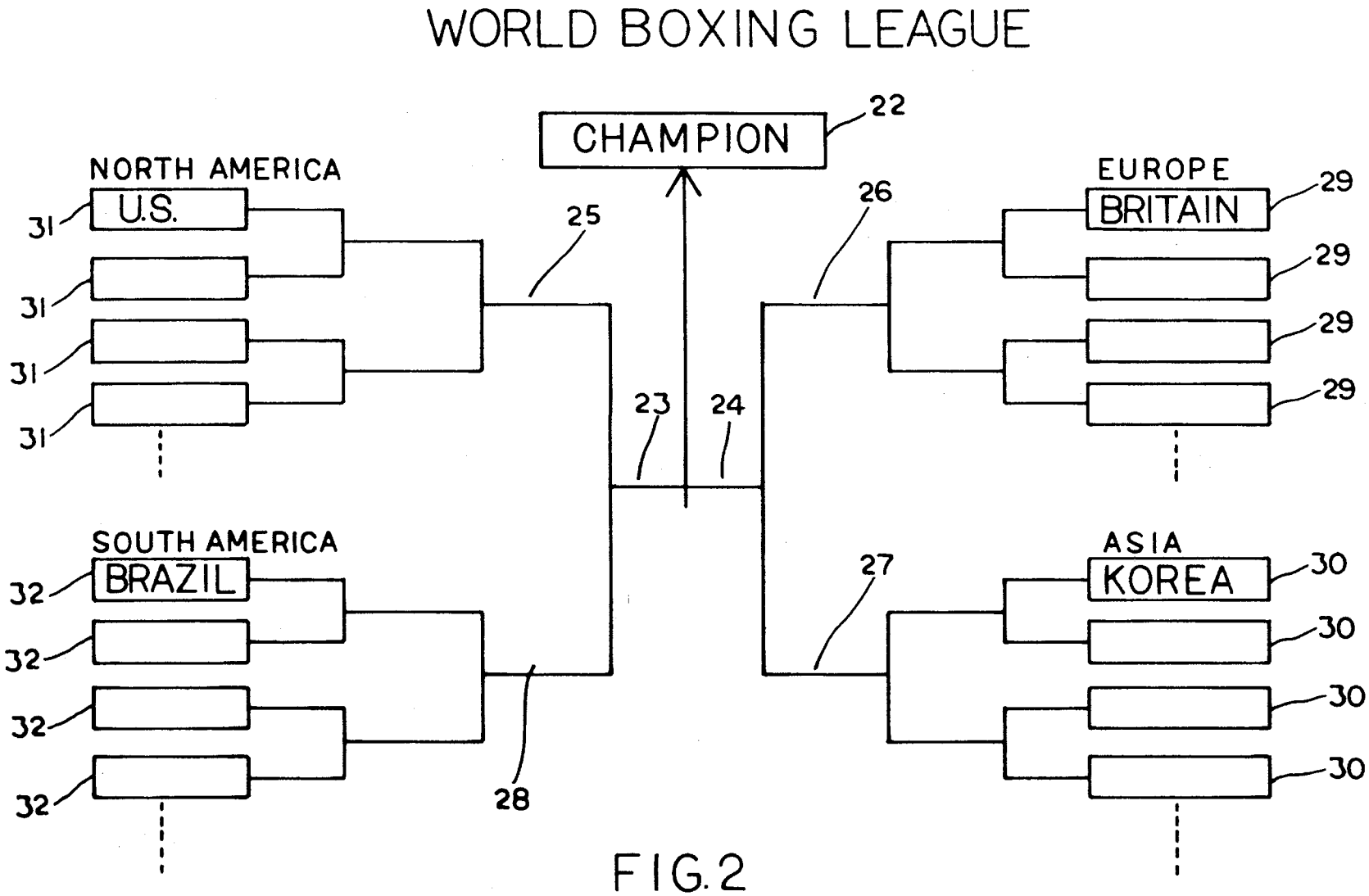

Sheet two contains FIG. 2, a Block flow diagram of a possible international tournament format. In this particular format, North American countries compete against South American countries to produce an America's Cup Champion. The European countries compete against the Asian countries to produce a championship team that will compete against the America's Cup championship team with the winner being crowned the World Boxing League Champion.

Figure 3:
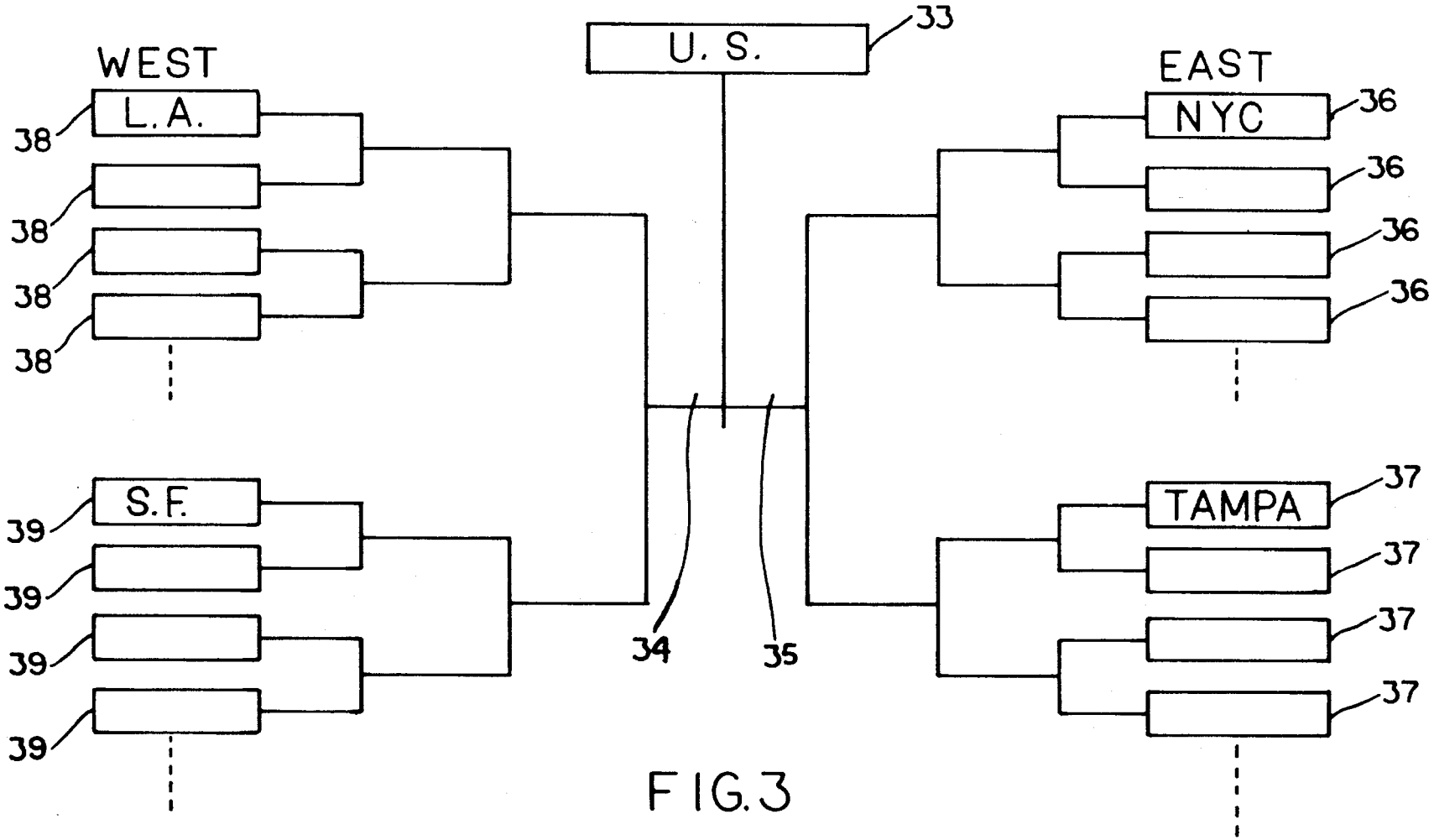

Sheet three contains FIG. 3, a Block flow diagram of a possible national tournament format. In this particular format, the cities of the United States will compete against other cities to produce a championship team that will represent the United States during international competition.

DESCRIPTION OF THE PREFERRED EMBODIMENTS

Figure 1:
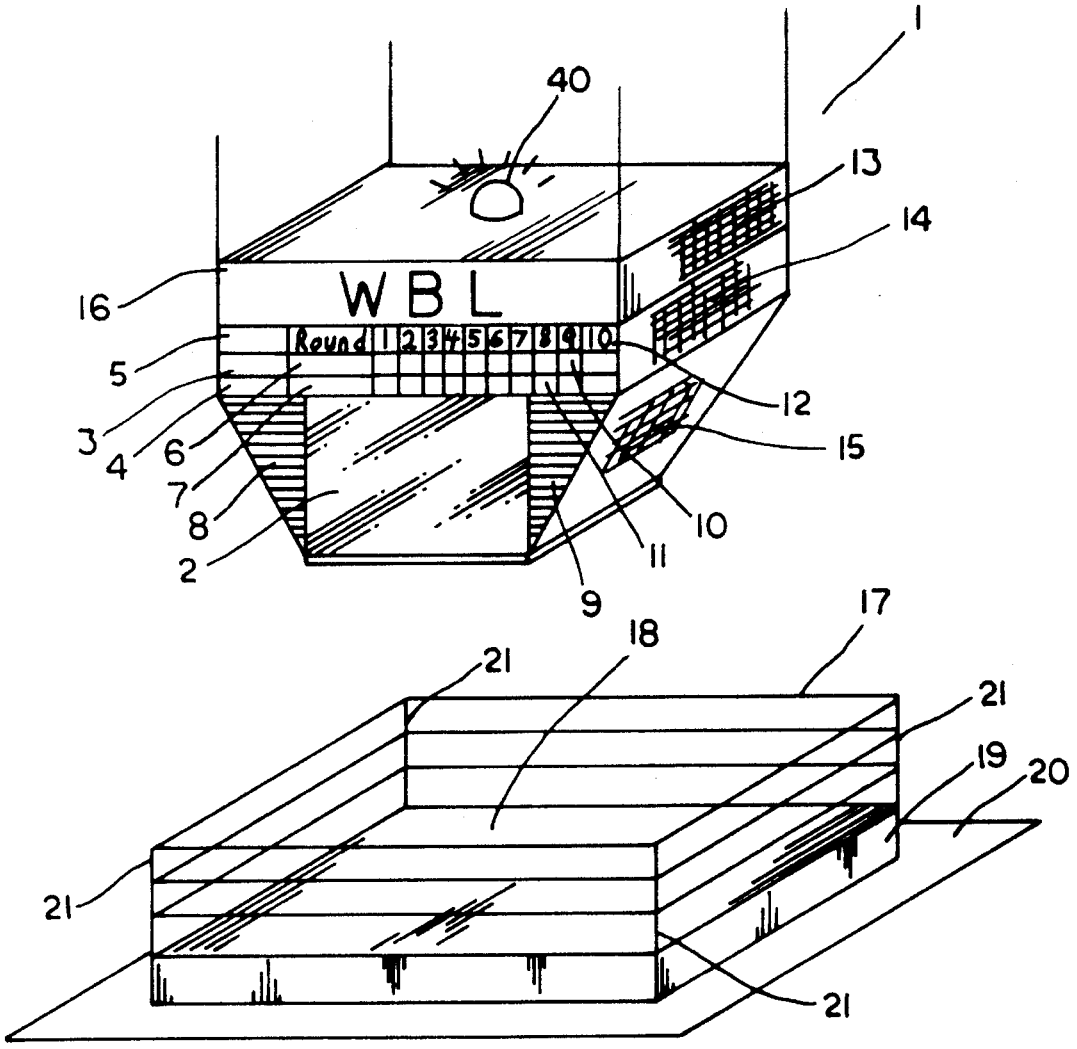

Referring now to FIG. 1, a boxing game system and method of play comprises a traditional boxing ring having a substantially square construction. The boxing ring having a set of ropes 17 encircling the ring thereby forming an enclosure. Each of the four corners of the boxing ring having a vertical pole 21 affixed thereto for suspending the set of ropes 17. The boxing ring further having a cushioned floor 18 being supported by a raised platform 19 that sits thereon the ground floor 20

Referring now to the open scoring apparatus suspended above the boxing ring referred to generally by the reference numeral 1. The open scoring apparatus 1 having a video display 2 affixed thereon having capabilities of displaying a plurality of video information. Commercial advertisement, highlights of the previous round, scores of other boxing bouts, as well as highlights of other boxing bouts being held across the country can be displayed thereon the video display during the interim periods of the boxing bout. Accompanying the video display 2 is an audio speaker system 8 and 9 for transmitting a plurality of audio messages or to amplify the sounds coming from the boxing ring vicinity during the boxing bout.

A round indicator column 12 affixed thereon the open scoring apparatus 1 is displayed with the scores given to each boxer in spaces 10 and 11 for that respective round. Spaces 3 and 4 are given to indicate the cumulative scores for the boxers identified by spaces 6 and 7 respectively. An advertising space 16 is provided thereon the open scoring apparatus 1 to allow for a plurality of advertising messages to be displayed.

Further information on the open scoring apparatus 1 is a punch statistics column given by numeral 13. The statistics column 13 displaying the number of punches thrown, the number of punches landed, the number of jabs thrown, the number of power punches thrown, and the percentage of these respective punches landed over punches thrown by each boxer. A further feature shown by the apparatus 1 is a team score column 14 displaying the scores for each boxer of each weight class division, also, the cumulative score for each team for the boxing bouts fought thus far. An individual judge's score column 15 is displayed to allow the public to view the scores given to each boxer from each judge during the boxing bout. Further information such as how much time is left during the three minute round and how much time is left during the one minute rest interval period are also displayed thereon apparatus 1.

Finally, affixed thereon the open scoring apparatus 1 is an audio visual indicator 40 that is activated during a boxing bout when one boxer is determined to be mathematically eliminated from winning by either unanimous or split decision. Once a boxer is mathematically eliminated by decision, the audio visual indicator is activated, which will inform the losing boxer that he now can only win by knockout. This should commence the losing boxer to fight harder in order to win the boxing bout by knockout.

Referring now to FIG. 2, we see a flow diagram of a plurality of countries from across the world vying to become the World Boxing League Champion 22. A plurality of countries 31 from the North American Continent will compete to become the North American Champion 25. Similarly, a plurality of countries 32 from the South American Continent will compete to become the South American Champion 28. Both the North and South American championship teams 25 and 28 respectively will compete to win the Americas Cup Championship 23.

In the adjacent bracket, a plurality of countries 29 from Europe will compete for the European title 26. Likewise, a plurality of countries 30 will compete for the Asian title 27. Both the European and Asian championship teams 26 and 27 respectively will compete to produce the Eastern nations champion 24 and will have the opportunity to compete against the Americas cup Champion 23 for the World Boxing League Championship title 22.

Referring now to FIG. 3, we see a possible flow diagram for producing a national championship team 33 of the United States. Boxing teams from cities of the western part of the nation 38 and 39 will compete to produce a championship team 34 representing the western cities. Similarly, boxing teams from cities of the eastern part of the nation will compete to produce a championship team 35 representing the eastern cities of the nation. Both western and eastern championship teams 34 and 35 respectively will compete to become the national championship team 33 of the United States of America.

It is preferred that each team consist of at least five boxers, with at least one boxer representing one of the five weight class divisions. A team may have more than one boxer for each weight class division for purposes of substituting boxers that are injured during the season of competition. The following preferred weight class divisions will be assigned for the boxers of different weights as follows.

WEIGHT CLASS DIVISIONS

| | |
|---|---|
| SUPER HEAVYWEIGHT DIVISION | BOXERS OVER 225 LBS |
| HEAVYWEIGHT DIVISION | BOXERS OVER 200 LBS–225 LBS |
| LIGHT HEAVYWEIGHT DIVISION | BOXERS OVER 175 LBS–200 LBS |
| MIDDLEWEIGHT DIVISION | BOXERS OVER 150 LBS–175 LBS |
| LIGHTWEIGHT DIVISION | BOXERS OVER 126 LBS–150 LBS |
| FLYWEIGHT DIVISION | BOXERS OVER 112 LBS–126 LBS |

Each specific weight class division will have a maximum rounds per boxing bout before the judge's total cumulative score is added to determine a winner of the boxing bout. The preferred following rounds per event will be assigned for each weight class division as follows.

ROUNDS PER EVENT

| | |
|---|---|
| SUPER HEAVYWEIGHT DIVISION | 10 ROUNDS MAXIMUM |
| HEAVYWEIGHT DIVISION | 10 ROUNDS MAXIMUM |
| LIGHT HEAVYWEIGHT DIVISION | 10 ROUNDS MAXIMUM |
| MIDDLEWEIGHT DIVISION | 8 ROUNDS MAXIMUM |
| LIGHTWEIGHT DIVISION | 8 ROUNDS MAXIMUM |
| FLYWEIGHT DIVISION | 8 ROUNDS MAXIMUM |

The boxers of each boxing bout for each weight class division will be given the following points pending the outcome of the boxing bout. The winning team will be the team having the most combined points from each of their boxers of each weight class division at the end of the final boxing bout. Points per boxer per boxing bout will be awarded to each boxer in the manner as set forth herebelow.

POINT SYSTEM

5 POINTS—WIN BY KNOCKOUT
4 POINTS—WIN BY TECHNICAL KNOCKOUT
3 POINTS—WIN BY UNANIMOUS DECISION
2 POINTS—WIN BY SPLIT DECISION
1 POINT—DRAW
1 POINT—DIFFERENCE BETWEEN ROUNDS WON vs ROUNDS LOST
0 POINTS—LOSS

EXAMPLE SCORECARD

| | NEW YORK BOMBERS | | | TAMPA BAY THUNDER | | |
|---|---|---|---|---|---|---|
| DIVISION | Decision | Rounds | Total | Decision | Rounds | Total |
| Super weight | 4 | 10 | 14 | 0 | 0 | 0 |
| Heavyweight | 5 | 9 | 14 | 0 | 0 | 0 |
| Lightweight | 2 | 2 | 4 | 0 | 0 | 0 |
| Middleweight | 0 | 0 | 0 | 3 | 3 | 6 |
| Flyweight | 0 | 0 | 0 | 5 | 5 | 10 |
| Strawweight | 2 | 2 | 4 | 0 | 0 | 0 |
| Total | 13 + 23 = 36 | | | 8 + 8 = 16 | | |
| N.Y. 36 Won Tampa 16 Lost | | | | | | |

The season of play will typically be given in a twelve month endeavor with the first eight months dedicated to league boxing bouts. Month nine would be for semi-final elimination boxing bouts. Month ten would consist of the league championship to find out what team will represent their country during the World Boxing League tournament. Month eleven would host the Americas cup i.e. the winner of North and South American countries and the winner of the European and Asian championship. Month twelve would culminate in the World Invitational Tournament.

LEAGUE CHAMPIONSHIP

A league championship for each country is held to determine the winning team to represent their country. The league consisting of teams representing different cities across that particular country. The top four winning teams competing for the title to be crowned the winner of that particular country and to represent the country in the world boxing league tournament.

Accordingly, a very unique method and apparatus are provided for the sport of team boxing. Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A method for playing the sport of boxing, said method comprising the steps of:

(a) forming a plurality of boxing teams from a plurality of boxers, said boxing teams representing a plurality of cities, (b) having said boxing teams from a plurality of said cities compete for a national title of a country, (c) having said boxing teams from a plurality of countries compete for a world championship title.

2. A method for playing the sport of boxing, said method comprising the steps of:

(a) forming a plurality of boxing teams from a plurality of boxers, said boxing teams representing a plurality of cities, said boxing teams having a plurality of weight divisions for said boxers, (b) having said boxing teams from a plurality of said cities compete for a national title of a country, (c) having said boxing teams from a plurality of countries compete for a world championship title.

3. A method for playing the sport of boxing as set forth in claim 2 wherein said boxing team having at least one boxer representing at least one weight class division.

4. A method for playing the sport of boxing as set forth in claim 3 wherein said weight divisions consisting of a plurality of weight divisions as follows, a heavyweight division for boxers over 200 pounds of weight, a light heavyweight division for boxers over 175 pounds to 200 pounds of weight, a middleweight division for boxers over 150 pounds to 175 pounds of weight, a lightweight division for boxers over 126 pounds to 150 pounds of weight, and a flyweight division for boxers over 112 pounds to 126 pounds of weight.

5. A method for playing the sport of boxing as set forth in claim 4 wherein said points given to said boxer by a panel of judges are openly displayed during the boxing bout.

6. A method for playing the sport of boxing as set forth in claim 2 wherein said boxing team wins by receiving more points than their opponent.

7. A method for playing the sport of boxing as set forth in claim 5 wherein said points being given to a boxer in the following manner, four points for a win by a knockout, three points for a win by a unanimous decision, two points for a win by a split decision, one point for a draw, and zero points for a loss.

8. A method for playing the sport of boxing as set forth in claim 2 wherein an audio visual indicator is activated when a losing boxer can no longer win the boxing bout by a decision.

* * * * *